United States Patent [19]

DeSantis et al.

[11] 4,298,563

[45] Nov. 3, 1981

[54] APPARATUS AND METHOD FOR COMPACTING PRISMATIC OR PYRAMIDAL ARTICLES FROM POWDER MATERIAL

[75] Inventors: Raymond P. DeSantis, Royal Oak; Herbert J. Puffer, Jr., Garden City, both of Mich.

[73] Assignee: PTX-Pentronix, Inc., Lincoln Park, Mich.

[21] Appl. No.: 163,932

[22] Filed: Jun. 27, 1980

Related U.S. Application Data

[63] Continuation of Ser. No. 952,708, Oct. 19, 1978, abandoned.

[51] Int. Cl.[3] ..... B30B 11/02; B22F 3/02

[52] U.S. Cl. ..... 264/111; 425/352; 425/412

[58] Field of Search ..... 425/78, 344, 345, 352, 425/353, 354, 355, DIG. 107, 47; 264/111

[56] References Cited

U.S. PATENT DOCUMENTS

| | | | |
|---|---|---|---|
| 1,502,528 | 7/1924 | Reulbach | 425/DIG. 107 |
| 1,679,408 | 8/1928 | Davis et al. | 425/78 |
| 2,336,982 | 12/1943 | Cremer | 425/78 |
| 2,411,379 | 11/1946 | Langhammer | 425/78 |
| 2,569,226 | 9/1951 | Carter | 425/352 X |
| 3,158,109 | 11/1964 | Stott | 425/345 |
| 3,318,265 | 5/1967 | Winters et al. | 425/345 |
| 3,332,367 | 7/1967 | Sperry et al. | 425/345 X |
| 3,414,940 | 12/1968 | Vinson | 425/78 |
| 3,507,009 | 4/1970 | Comly | 425/345 |
| 3,561,056 | 2/1971 | Smith et al. | 425/78 |
| 3,565,016 | 2/1971 | Christie | 425/345 X |
| 3,775,032 | 11/1973 | Smith et al. | 425/78 |
| 3,826,599 | 7/1974 | DeSantis et al. | 425/78 |
| 4,047,864 | 9/1977 | DeSantis | 425/78 |
| 4,061,452 | 12/1977 | DeSantis | 425/78 |
| 4,104,014 | 8/1978 | Pearce | 425/354 X |
| 4,105,379 | 8/1978 | Gazuit | 425/47 |

*Primary Examiner*—J. Howard Flint, Jr.
*Attorney, Agent, or Firm*—Hauke & Patalidis

[57] ABSTRACT

An apparatus and method for compacting powder material into a prismatic or pyramidal article in a molding cavity formed by the end face of a lower punch reciprocable in a die bore, a portion of the die bore and the end faces of a pair of telescopic concentric punches being disposed above the die bore. The lower punch end face forms an end surface of the prismatic or pyramidal article, the die bore wall forms the peripheral surface of the article, and the upper telescopic punches form the other end surface of the article, one of the telescopic punches being disposed peripherally to the other punch and forming a sharp edge between the peripheral surface of the article and its other end surface.

13 Claims, 11 Drawing Figures

FIG. 2
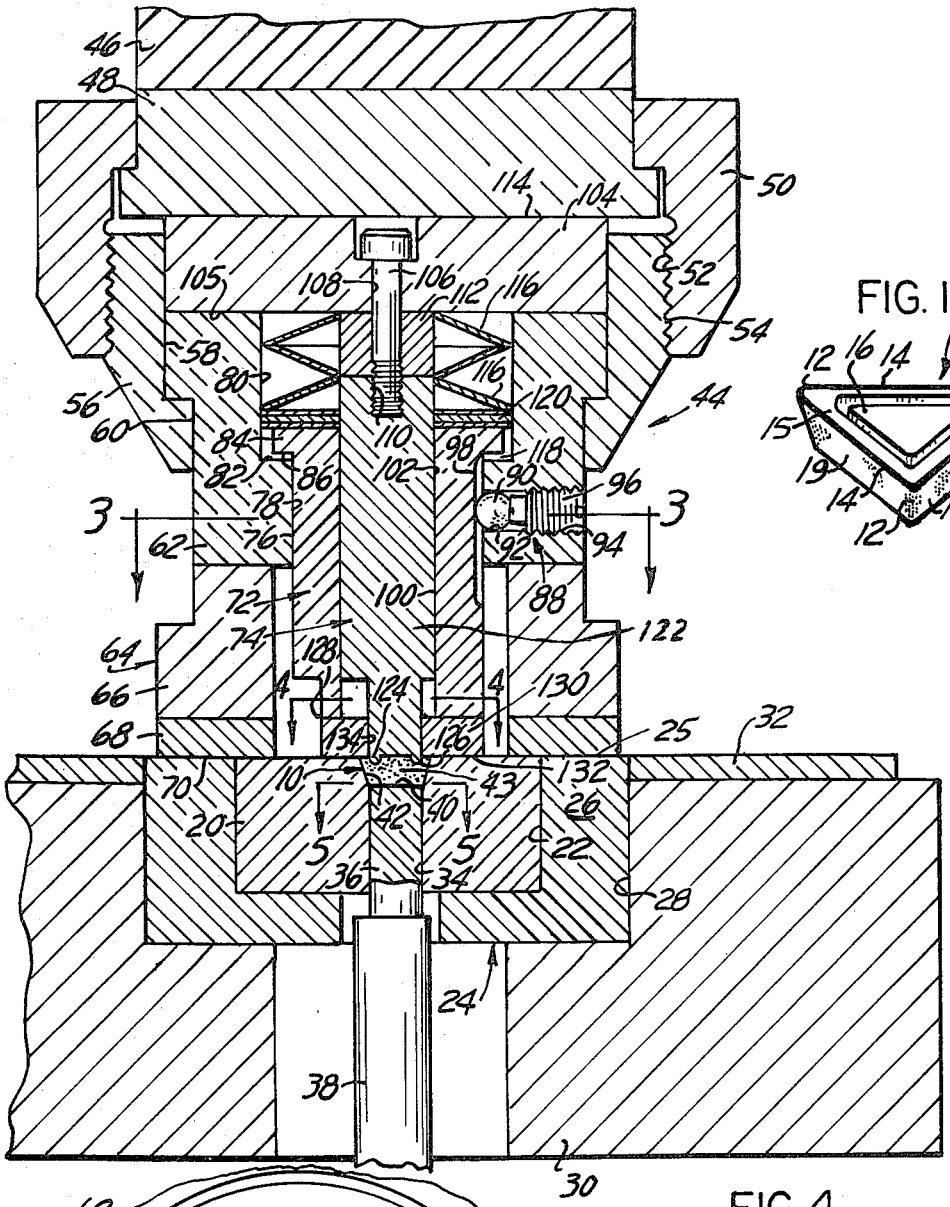
FIG. 1
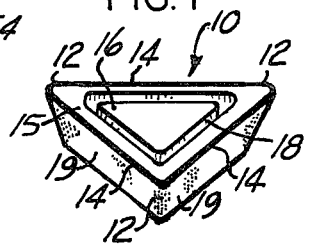
FIG. 4
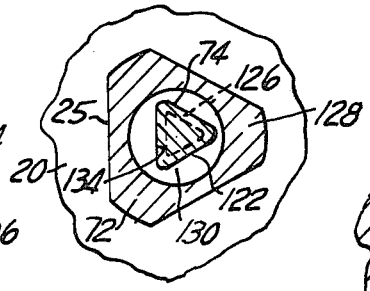
FIG. 5
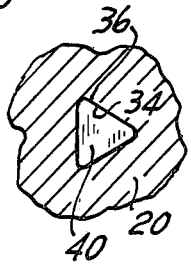
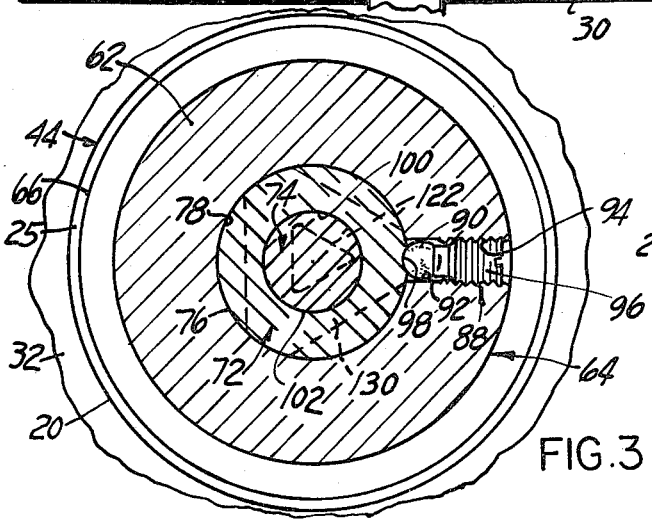
FIG. 3

FIG. 6
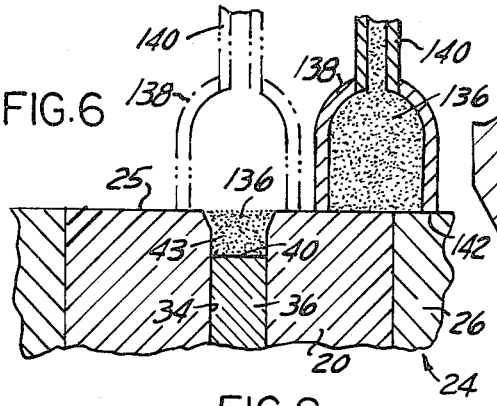
FIG. 7
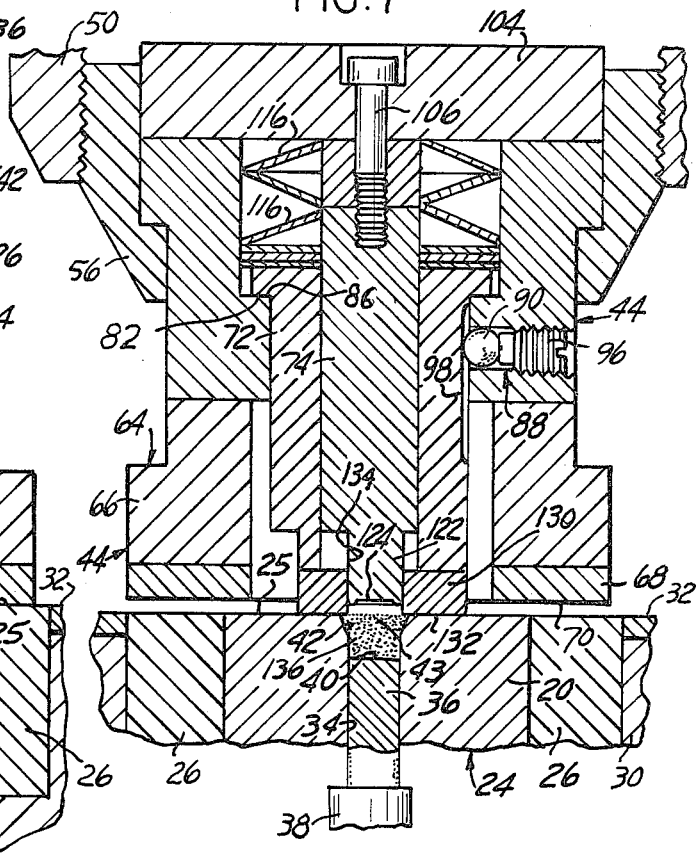
FIG. 8
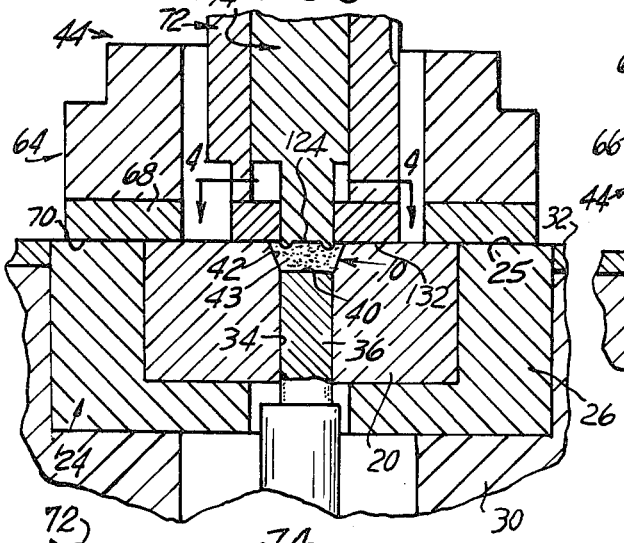
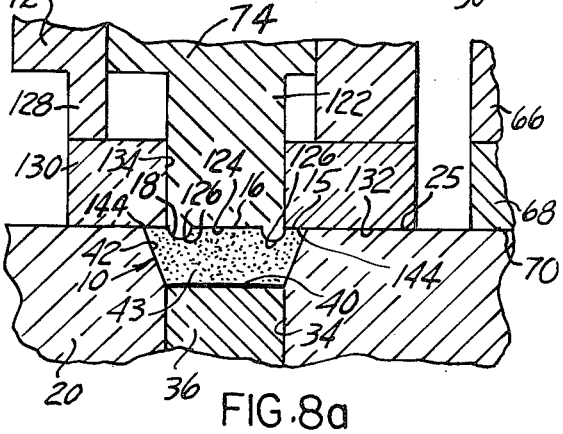
FIG. 8a
FIG. 9
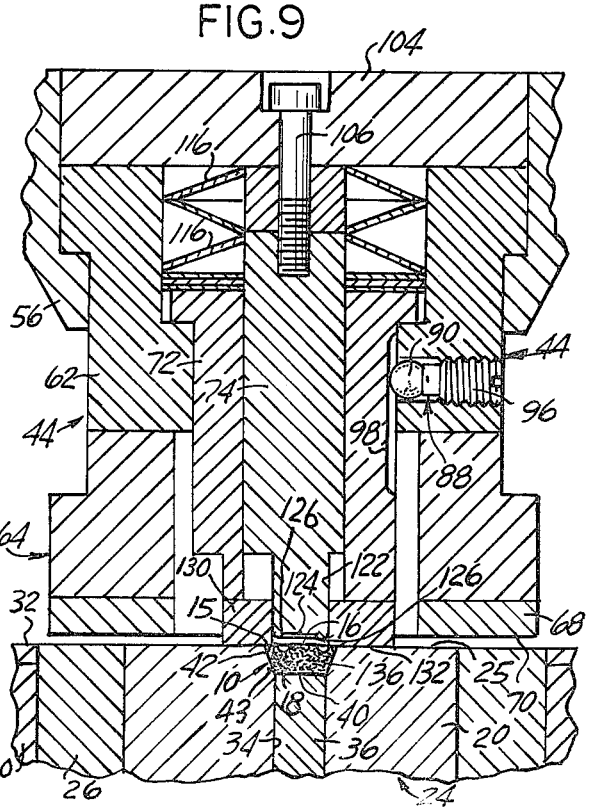
FIG. 10
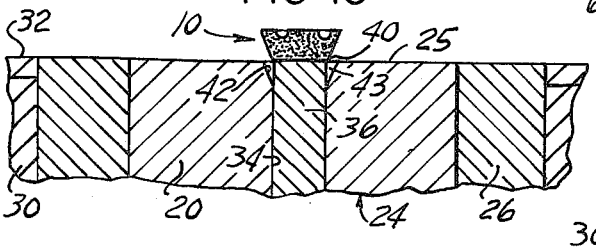

APPARATUS AND METHOD FOR COMPACTING PRISMATIC OR PYRAMIDAL ARTICLES FROM POWDER MATERIAL

This is a continuation of application Ser. No. 952,708, filed Oct. 19, 1978, now abandoned.

CROSS REFERENCE TO RELATED PATENTS

The present application is an improvement on the punch and die assemblies for compacting powder material disclosed and claimed in U.S. Pat. Nos. 3,775,032, 4,047,864, 4,061,452 and 4,061,563, all assigned to the same assignee as the present application.

BACKGROUND OF THE INVENTION

The present invention relates to powder-compacting apparatus and method and, more particularly, to an apparatus and method producing compacted articles within very close dimensional tolerances, with uniform density, and with sharp edges. A particular application for which the present invention is specifically well suited is the production of indexable throwaway cutting inserts for cutting tools, made of powder metals and metal alloys which, after sintering, requires very little grinding, if any, of the cutting edges and tips.

The present invention is concerned with improved tooling for use in powder-compacting presses such as are disclosed in U.S. Pat. Nos. 3,826,599, 3,775,032, 3,730,659, 3,726,622, 3,645,658, 3,574,892, 3,561,056, 3,516,142, 3,344,213 and 3,328,840, all of which are assigned to the same assignee as the present application.

In the powder-compacting presses disclosed in the aforementioned U.S. Patents, articles are compacted and formed in a single- or multi-cavity die forming part of a punch and die set, with the finished articles being automatically ejected from the die cavities, picked up by a vacuum pick-up head, and conveyed into suitable receptacles. A work station positioner assembly, which is part of the press, is mounted linearly or angularly movable transversely over the die plate. The work station positioner carries a powder dispenser, an anvil and the pick-up head. The powder dispenser, which is supplied with powder from a primary powder supply connected thereto by means of a flexible tubing or the like, is first positioned over the die cavity or cavities which are thus filled with powder as the punches are displaced dowwardly so as to draw a predetermined amount of powder into the die cavity or cavities. The dispenser is then removed from above the die cavity or cavities by the subsequent motion of the station positioner assembly, and the anvil is, in turn, positioned over the die cavities. The anvil is clamped over the die cavity by means of a pivotable clamp supported above the anvil and is acutated in timed relation with the movement of the punches. The anvil is held down with sufficient pressure to permit the compaction of the powder against the anvil as a result of an upward motion of the punches into the die cavity of cavities. The anvil is then removed from its position over the die cavity or cavities and is replaced by the pick-up head as a result of a further linear or angular motion of the work station positioner transversely across the face of the die plate. The punches are displaced upwardly so as to being their upper ends in substantial flush alignment with the upper surface of the die plate, such that the finished compacted articles are ejected from the die cavities and picked up by the pick-up head. As the result of a return linear or angular motion of the work station positioner to the initial fill position, the pick-up head is removed from over the die cavity and is disposed over one or, if a plurality of die cavities are employed, a series of discharge apertures arranged in a disposition similar to the arrangement of the die cavities in the die plate, and the finished compacted article or articles are drawn, as by vacuum, through the discharge aperture or apertures into a container or separate containers.

Alternatively, the compacted articles are drawn directly into the pick-up head by suction and transported to a remote discharge station by way of tubular conveyors through which the compacted articles are propelled by suction, or a flow of air, or a combination of both.

In U.S. Pat. Nos. 3,775,032, 4,047,864, 4,061,452 and 4,061,453, tooling arrangements for compacting articles from powder material are described in which a mold cavity is defined partly by the end face of an upper punch projecting through an anvil element above the die cavity, partly by the die bore wall and partly by the end face of the lower punch.

The present invention is an improvement on the tooling arrangements disclosed and claimed in the aforesaid patents which permits to obtain compacted articles, generally of a prismatic or pyramidal shape and having remarkably sharp edges. The forming of sharp edges is an advantageous feature where such sharp edges are desirable, as is the case when compacting powder metals and powder alloys are used for forming a "green" cutting tool insert or bit which is subsequently sintered to a solid mass of ultra-hard material.

SUMMARY OF THE INVENTION

The present invention accomplishes its objects by providing a molding apparatus for compacting powder material in a die or molding cavity having a bore in which is disposed a reciprocably movable lower punch, and at least a pair of coaxially disposed upper punches which are disposed movable to a work position above the die bore from a position away from the die bore. When disposed to their work position the lower face of the center upper punch is displaced such as to be substantially flush with the surface of the die, while the lower face of the peripheral upper punch abuts the surface of the die. The end face of the central upper punch forms the upper surface of the compacted article when the lower punch is displaced upwardly to compact the powder material previously placed in the die or mold cavity, and the peripheral upper punch forms the upper surface of the article at its sharp edges.

The many objects and advantages of the present invention will become apparent to those skilled in the art when the following description of an example of the best mode contemplated for practicing the invention is read in conjunction with the accompanying drawing wherein:

BRIEF DESCRIPTION OF THE DRAWING

FIG. 1 is a perspective view of an example of compacted article, such as an indexable throw-away cutting bit for a cutting tool, produced by the tooling arrangement for powder-compacting press of the present invention;

FIG. 2 is a broken sectional view of an example of apparatus for compacting the article of FIG. 1, with the respective elements shown in their relative position at the end of a compacting cycle;

FIG. 3 is a transverse section through line 3—3 of FIG. 2;

FIG. 4 is a partial transverse section through line 4—4 of FIG. 2;

FIG. 5 is a partial transverse section through line 5—5 of FIG. 2;

FIG. 6 is a partial view thereof showing the relative position of the lower punch in the die bore prior to compacting the powder material disposed in the die cavity.

FIG. 7 is a view similar to FIG. 6, but showing the upper punch assembly placed over the die cavity prior to the compacting step;

FIG. 8 is a view showing a portion of the structure of FIG. 7 at the end of a compaction cycle, as also represented at FIG. 2;

FIG. 8*a* illustrates a portion of the structure of FIG. 7 shown in the same position as in FIG. 8 at an enlarged scale;

FIG. 9 is a view similar to FIG. 7 and showing the relative position of the diverse elements of the invention after the article compaction step; and FIG. 10 is a view illustrating the ejection of the compacted article from the die cavity.

DETAILED DESCRIPTION OF THE PREFERRED EMBODIMENT

The present invention is particularly well suited for forming articles compacted of powder material, having a prismatic, prismatoidal, wedge, frusto-conical or frusto-pyramidal shape, more particularly where it is desired to provide the article with a sharp peripheral edge. As example of such article is illustrated at FIG. 1 which represents a "green" indexable throw-away cutting insert 10 made, for example, of tungsten carbide or carbides powder, particles or other refractory metal carbides, nitrides, or the like, mixed with a small quantity of softer metal particles and a binder, compacted to an appropriate shape, such as the triangular shape illustrated. After being formed to an appropriate shape, for example to the shape illustrated, the relatively fragile "green" cutting insert 10 is sintered at an appropriate high temperature. Sintering causes the binder to evaporate, carbonize and/or combine with the relatively low melting soft metallic particles which are melted at the temperature of sintering such as to form an ultrahard block of metallic carbide particles or the like, structurally held together by means of a lattice or matrix of the metallic cement resulting from the melting of the fine particles of the relatively low melting metal or metal alloy. The diverse techniques and processes for obtaining ultra-hard metallic alloy cemented cutting inserts are well known in the art, and are not part of the present invention. Suffice it to mention that after the "green" cutting inserts have been sintered, and also generally quenched, with the sintering operation causing considerable dimensional shrinkage, the now-hard block of cemented carbide or the like is ground and lapped to provide it with precise dimensions, a particular shape and most importantly sharp cutting edges and tips. The present invention presents the advantage of providing a method and apparatus capable of obtaining "green" cutting inserts, among other articles, which, after sintering, require no or very little sharpening of the cutting edges and tips.

Referring once again to FIG. 1, the compacted article 10 is an example of "green" cutting insert which, due to its triangular shape, is provided with three indexable sharp cutting tips 12 interconnected by sharp cutting edges 14, the upper surface 16 of the insert 10 being provided with a continuous chip breaker groove 18 disposed proximate and generally parallel to the cutting edges 14. A flat ledge 15 is disposed between the chip breaker groove 18 and the cutting edges 14. The sidewalls 19 of the cutting insert 10 form with the upper surface 16 and the flat ledge 15 and angle of less than 90°, thus defining a positive rake cutting insert when mounted in a tool holder presenting a cutting tip 12 or a cutting edge 14 of the insert to a cylindrical workpiece mounted in the chuck of a lathe with the plane of the top surface 16 and of the ledge 15 of the cutting insert 10 along a diameter of the workpiece, as is also well known in the metal cutting art.

In order to be effective as a metal cutting implement, the insert cutting tips 12 and cutting edges 14 need be as sharp as possible, and this is accomplished conventionally by finish grinding the top surface 16 and ledge 15 and the side faces 19 of the insert 10 generally illustrated at FIG. 1. Sharp cutting edges requiring no subsequent grinding or lapping are generally impossible to achieve when cutting inserts are compacted from powder materials by conventional techniques. The present invention however by means of the structure herein illustrated at FIGS. 2–5 permits to achieve the desirable results of compacting, among other articles, cutting insert requiring no, or very little, grinding or lapping as a finish manufacturing operation.

Referring now to FIGS. 2–5, there is illustrated an apparatus according to the present invention for molding a generally pyramidal or prismatic article, such as the "green" cutting insert 10 of FIG. 1. The molding apparatus comprises a die consisting of a die bushing 20 press-fitted, cemented or otherwise disposed in a bore 22 in a die plate 24. The die bushing 20 is preferably made of hard material, such as tungsten carbide or the like, and the die plate 24, although it may be made of a heat-treated tool steel, is preferably also made of a carbide, and is provided with a highly polished upper surface 25. Although the die plate 24 may be made of a single thick plate, in the structure illustrated at FIG. 2 the die plate 24 is shown as comprising a block 26 of steel or tungsten carbide provided with a blind bore 22 accepting the die bushing 20. The block 26 is in turn press-fitted or otherwise mounted in a recess 28 formed in a thick plate 30 mounted in the table of a powder-compacting apparatus, now shown, of the type disclosed in the afore-mentioned Letters Patent. In the structure illustrated, the upper surface of the thick plate 30 is provided with a relatively thin plate 32 of highly polished hard steel, tungsten carbide, or the like, fastened thereon by any convenient means such as bolts or the like, not shown.

The die bushing 20 is provided with a bore 34 in which is reciprocably disposed a lower punch 36 which is also made preferably of an ultra-hard material such as tungsten carbide, and which is reciprocable up and down in the die bore 34 by means of a push rod 38, on the end of which it is mounted, the push rod 38 being in turn connected to the lower ram of the press, not shown.

The die bore 34 has a peripheral shape conforming to the peripheral shape of the lower punch 36 which, in the example of structure illustrated, is in the form of an equilateral triangle having rounded corners, the end face 40 of the lower punch 36 having an area corresponding to the area of the lower face of the cutting insert 10 of FIG. 1. The upper end of the die bore 36 is provided with tapered walls 42, such as to form the tapered sidewalls 19 of the frusto-pyramidal article or cutting insert 10 of FIG. 1, the tapered walls 42 and the end face 40 of the punch 36 defining a die cavity 43.

An upper punch anvil assembly 44 is disposed above the die assembly 24, for controlled positioning over the die cavity 43 and away from the die cavity 43 as operated by the press mechanism in coordination with the motion of the lower punch 36, during filling of the die cavity 43 with powder material, compacting of the article 10 in the die cavity, and ejection of the finished article from the die cavity. For that purpose, the upper punch-anvil assembly 44 is mounted in a work station positioner assembly, not shown, in which are also mounted a powder dispenser and a pick-up head, as disclosed and detailed in the aforementioned patents. As also mentioned in the aforesaid patents, the work station positioner assembly is linearly or arcuately movable by an appropriate mechanism of the press apparatus such as to sequentially place over the die cavity 43 the powder dispenser for filling the die cavity with powder material, the punch-anvil assembly 44 for compacting in the die cavity the powder material to a finished article, and for replacing the punch-anvil assembly 44 by a pick-up head or other ejection mechanism during ejection of the finished article from the die cavity. The work station positioner assembly, the powder dispenser and the ejection mechanism are not represented in the drawing for the sake of simplification, and as they are not necessary for a proper understanding of the present invention. Alternatively, the upper punch-anvil assembly 44 may be mounted on the end of the upper ram of a powder-compacting press of the type disclosed in U.S. Pat. No. 4,061,453, and in such arrangement, the work station positioner assembly carries only the powder dispenser and the ejection mechanism the whole assembly 44 being removed from over the die cavity 42 during the upstroke of the press upper ram. The latter arrangement has been arbitrarily chosen in the representation of FIG. 2, wherein the upper punch-anvil assembly 44 is directly mounted on the end of the upper ram 46 of the press apparatus.

The ram 46 is provided on its end with a shouldered mounting plate 48 fastened thereon by any convenient means such as screws, bolts or the like, not shown. The shouldered mounting plate 48 has a circular periphery, and the assembly 44 is fastened to the end face of the mounting plate 48 by means of a mounting ring 50 having a threaded bore 52 threadably engaging the threaded periphery 54 of a retainer ring 56 having a stepped inner bore 58 engaging the stepped outer surface 60 of the upper portion 62 of a cylindrical tubular housing 64. The tubalar housing 64 has a lower portion 66. The lower portion 66 is fastened at its top to the bottom of the upper portion 62 of the housing 64 by means of screws or bolts, not shown, and is provided at its lower end face with an annular plate 68 preferably made of hard steel or tungsten carbide or the like, and having a highly polished face 70 engageable with the upper surface 25 of the die plate 24. The annular plate 68, or shoe, is attached to the lower surface of the lower portion 66 of the housing 64 by any convenient means such as bolts or screws, not shown. The housing 64 is made in two sections, 62 and 66, for convenience of manufacturing and assembly.

A pair of concentric telescopic punches 72 and 74 are disposed slidably within the housing 64. The punch 72, or outer punch, is circularly cylindrical and its peripheral surface 76 slidably engages the wall of a reduced diameter bore portion 78 of the upper portion 62 of the housing 64. The upper portion 62 of the housing 64 has an enlarged diameter bore portion 80, such that an annular abutment surface 82 is formed between the enlarged diameter bore portion 80 and the reduced diameter bore portion 78. The outer punch 72 has an enlarged diameter portion 84 freely disposed in the enlarged diameter bore 80 of the housing upper portion 62, and forming an annular abutment surface 86 engageable with the annular abutment surface 82 in the housing for limiting, in a downward direction, the displacement of the outer punch 72 relative to the housing 64.

The periphery of the upper outer punch 72 being circular for simplification of manufacturing, an anti-rotation device 88 is provided for linearly guiding the outer punch 72 and preventing rotation around its longitudinal axis. The anti-rotation device 88 comprises a steel or tungsten carbide ball 90 placed in a radial bore 92 in the upper housing portion 62. The outer end of the radial bore 92 is internally threaded, as shown at 94, such as to accept a set screw 96, preferably a dog point set screw, which, according to the setting imparted on the set screw 96, urges the ball 90 with more or less pressure into a longitudinal groove 98 formed in the peripheral surface 76 of the outer punch 72.

The outer punch 72 has a longitudinal circularly cylindrical bore 100 slidably receiving the inner punch 74 provided with a corresponding circularly cylindrical peripheral surface 102. The upper end of the inner punch 74 is fastened to the lower surface of a mounting plate 104 by means of a bolt 106 disposed in a countersunk bore 108 through the mounting plate 104 and having a threaded end engaging a threaded longitudinal blind bore 110 disposed centrally at the end of the inner punch 74, a relatively thick spacer washer 112 being disposed between the upper end face of the inner punch 74 and the lower surface 105 of the mounting plate 104. The upper face 114 of the inner punch mounting plate 104 engages the lower face of the mounting plate 48 on the end of the ram 46, and its lower face 105 engages the upper face of the housing portion 62, when the assembly 44 is mounted on the end of the ram 46 and the mounting ring 50 is appropriately tightened.

A plurality of compressed Belleville springs 116 are disposed around the periphery of the spacer washer 112 and the periphery of the upper end of the inner punch 74, in the annular space formed between such peripheries and the enlarged inner diameter bore 80 of the upper housing portion 62. The Belleville springs 116 constantly urge the outer punch 72 downwardly relative to the inner punch 74, the amount of permissible motion of the outer punch 72 relative to the inner punch 74 being determined by the distance between the annular abutment surface 86 of the outer punch 72 and the annular abutment surface 82 separating the reduced diameter bore 78 and the enlarged diameter bore 80 of the housing upper portion 62. Annular shims, not shown, may be disposed in that space 118 to adjust the amplitude of such relative motion, and an appropriate thickness of annular shims 120 is generally disposed between the lower Belleville spring 116 and the upper end face of the outer punch 72 to appropriately set to a desirable value the pressure exerted by the Belleville springs 116 on the upper end face of the outer punch 72.

The inner punch 74 is preferably made of tungsten carbide, or like material, and is provided proximate its lower end with a generally triangularly shaped reduced diameter portion 122, best shown at FIGS. 3 and 4, to conform with the shape of the article 10 compacted from powder material by way of the apparatus of the invention. It will be appreciated that when it is desired to compact from powder material an article having a shape other than triangular, the reduced diameter portion 122 of the inner punch 74 is provided with an appropriately conforming shape. The reduced diameter portion 122 of the inner punch 74 has a generally triangular end face 124, for forming the upper surface 16 of the article 10, FIG. 1, which is provided at its perimeter with a continuous ridge 126 for forming the groove 18 of the article 10.

The lower end 128 of the outer punch 72 is also provided with a triangular shape on its periphery and carries a similarly shaped plate 130 made of carbide or like material, highly polished at its lower face 132, and provided at its center with a triangular bore 134 slidably accepting the triangular end 122 of the inner punch 74. As the triangular end 122 of the inner punch 74 is disposed in the triangular bore 134 of the end plate 130, the inner punch 74 is restrained against rotation around its longitudinal axis relative to the outer punch 72 which in turn is restrained against rotation by the anti-rotation device 88.

Although it is evident that the end plate 130 mounted at the lower end of the outer punch 72 needs not have a triangular periphery, with rounded corners, for the sake of precision in dimensions and density and for the sake of applying even pressure on the upper surface 25 of the die 24, it is preferable to have a shape for the end plate 130 which corresponds to the shape of the die bore opening, to provide equal areas of engagement between the lower surface 132 of the plate 130 and the surface 25 of the die 24 to balance the pressure applied to the die surface 25 around the die cavity 43.

FIGS. 6–10 illustrate the relative positions of the moving elements of the apparatus of the invention, at successive steps from the filling of the die cavity 43 with powder material 136, FIG. 6, to the ejection from the die cavity of the finished compacted article 10, FIG. 10. At FIG. 6, the die cavity 43 is shown after filling with powder material 136 from a primary dome-shaped powder hopper or dispenser 138 placed in communication with a secondary powder dispenser, not shown, by means of a flexible tubing 140. The powder dispenser 138 is mounted on the press apparatus work station positioner, not shown, as explained in detail in the aforesaid patents, and is linearly or arcuately displaceable over the surface 25 of the die and die plate, to the position over the die cavity 43 shown in phantom line in the drawing, such as to fill the die cavity with the powder material 136. When displaced away from the die cavity 43, the lower lip 142 of the dome-shaped powder dispenser 138, which is constantly in engagement with the surface 25 of the die and die plate, leaves in the die cavity 43 a predetermined volume of powder material 136 which is in part depending upon the position of the end face 40 of the lower punch 36, the lip 142 of the powder dispenser 138 evening the load of powder 136 in the die cavity 43 to a level flush with the surface 25.

After the die cavity 43 has been filled with powder 136, and the powder dispenser 138 linearly or arcuately displaced out of the way, the upper punch-anvil assembly 44 is in turn placed over the die cavity 43 as illustrated at FIG. 7. In arrangement where the assembly 44 is mounted on a work station positioner, the assembly 44 is linearly or arcuately displaced with the lower surface 132 of the end place 130 of the outer punch 72 constantly in sliding engagement with the upper surface 25 of the die and die plate, to a position corresponding to the position illustrated at FIG. 7. In the example of structure illustrated however, the assembly 44 being directly mounted on the end of the ram 46 of the press, as illustrated in detail at FIG. 2, is raised out of the way by the ram 46 during filling of the die cavity 43 with powder, FIG. 6, and when the finished part, after compaction, is ejected from the die cavity, FIG. 10. Appropriate guiding columns, not shown, are used for supporting and guiding the housing 64 of the assembly 44 during reciprocating motion of the press ram, as particularly disclosed in U.S. Pat. No. 3,826,599. Toward the end of the downward stroke of the ram, the end plate 130 of the outer punch 72 is the first to engage its lower face 132 with the die and die plate surface 25, FIG. 7, because the Belleville springs 116 constantly urge the outer punch 72 downwardly, with the annular shoulder surfaces 86 and 82 respectively of the outer punch 72 and of the housing 64 in engagement with each other, causing the lower surface 70 of the housing end plate 68 and the end face 124 of the inner punch 74 to be substantially at the same level and out of contact respectively with the upper surface 25 of the die and die plate and the level of the powder material 136 in the die cavity 43.

As further shown at FIG. 7, the end of the bore 134 in the end plate 130 of the outer punch 72 is disposed over the die cavity 43, and the end face 132 of the end plate 130 is engaged securely with the die and die plate surface 25 around the periphery of the die cavity opening as a result of the further compression of the Belleville springs 116 when the press ram continues its downward stroke. At the end of the ram downward stroke, the lower surface 70 of the housing end plate 68 has been advanced to also engage the die and die plate surface 25, while simultaneously the end face 124 of the inner punch 74 has been advanced such as to engage the level surface of the load of powder material 136 in the die cavity 43, FIG. 8. Simultaneously therewith, the lower punch 36 is displaced upwardly such that, at the end of the compaction stroke, the diverse elements occupy the position illustrated in detail at FIG. 2 and partially at FIGS. 8 and **8*a*. In that position, namely at the end of the compaction step, the lower surface 70 of the housing end plate 68 is in firm engagement with the die and die plate surface 25, and the lower surface 132 of the outer punch end plate 130 is also in firm engagement with the surface 25. The inner upper punch 74 remains stationary at the end of its downward stroke such that the upward stroke of the lower punch 36 compacts the powder material 136 against the end face 124 of the inner upper punch 74 which thus forms the upper face 16 of the article or cutting insert 10, while the ribs 126 on the end face 124 of the inner upper punch 74 form the groove 18 in the upper surface 16 of the article 10. As best shown in the enlarged view of FIG. 8*a*, the lower edge surface of the outer upper punch end plate 130 which overlaps the opening of the die cavity 43, identified by numeral 144 which was positioned in that overlapping position over the opening of the die cavity 43 prior to the compaction step, forms with the tapered wall 42 of the die cavity 43 a very sharp edge 14 for the article 10, and a smooth ledge 15 between the groove 18 and the sharp edge 14. For forming an article 10 such as the cutting insert of FIG. 1, the end face 40 of the lower punch 36** is preferably slightly convex, as also best shown at FIG. 8*a*, such that the lower face of the insert, even after sintering, is slightly concave. This provides a more stable seating of the cutting insert in the receiving pocket of a tool holder, where the insert is supported by the pocket flat bottom surface engaging the lower surface of the insert proximate the outer edge thereof, thus giving the insert maximum support directly below where most of the load is applied to the insert, namely close to or directly below the cutting edge 14 as feasible.

FIG. 9 represents the relative position of the movable elements of the apparatus of the invention after the article 10 has been compacted and the ram of the press apparatus has relieved the pressure applied on the mounting plate 104 of the upper punch assembly 44. The end plate 68 of the housing 64 has been lifted from the die surface 25, and the end face 124 of the inner punch 74 has simultaneously been lifted from the upper face 16 of the article 10 as a result of allowing the Belleville springs 116 to expand. However, while the pulling away of the end face 70 of the housing plate 68 and of the end face 124 of the inner punch 74 was taking place, the lower face 132 of the end plate 130 of the outer upper punch 72 remains in contact with the die and die plate surface 25, thus continuing to hold the article 10 in the die cavity 43 by engaging the marginal ledge 15 of the article, while the end face 124 of the inner punch 74 and the ridge 126 on the punch end face are disengaged respectively from the top surface 16 and from within the groove 18 of the compacted article 10. In arrangement where the housing 64 is mounted on a work station positioner, the whole upper punch assembly 44 is then displaced away from over the die cavity 43, with the lower surface 143 of the outer punch end plate 130 remaining engaged with the die surface 25, and in arrangement like the one illustrated in the drawing, subsequent upstroke of the press ram lifts the whole assembly 44 away from over the die cavity 43.

The lower punch 36 is subsequently advanced upwardly until its end face 40 is substantially flush with, or slightly above, the die and die plate surface 25, as illustrated at FIG. 10, to eject the article 10 from the die cavity. The rake portion of an appropriate mechanical ejection device, not shown, removes the article to a receptacle or, alternatively, a vacuum pick-up head, not shown, is placed over the die cavity to pick up the finished compacted article 10, as explained in details in the hereinbefore referred to U.S. patents.

Although the present invention has been described and illustrated as an apparatus and method specifically adapted to compact from powder material a "green" cutting insert for use in a cutting tool, such cutting insert having a well-defined geometry, it will be readily apparent to those skilled in the art that the principle and the structure for practicing the present invention are directly adaptable to a compacting "green" cutting insert of any geometry different from that disclosed herein for illustrative purpose only, and for compacting articles of diverse powder materials, metallic and nonmetallic, and of diverse configurations, where it is desired to provide the compacted article with a sharp edge at the junction of two surfaces of said article. Where it is desired to provide the compacted article with an aperture extending from a surface to another surface of the article, as is often the case for cutting inserts held in a tool by means of a screw or eccentric pin, such an aperture is formed in the article by means of an appropriate core rod generally disposed concentric with the lower punch and stationarily held in an adjustable fixed position, as also disclosed in detail in the aforesaid U.S. patents.

In arrangements where, for example, the aperture 134 in the outer upper punch 72 end plate 130 is circular, and the end portion 124 of the inner punch 74 is circularly cylindrical, an anti-rotation device alike the anti-rotation device 88 may be disposed through the wall of the outer punch to prevent rotation of the inner punch relative to the outer punch, or any other anti-rotation device may be used such as a key and co-operating keyway.

In the appended claims, the term "punch" is used to designate the lower punch and the terms "counterpunches" are used to designate the upper punches.

Having thus described the invention by way of an example of structural embodiment thereof, modification whereof will be apparent to those skilled in the art.

What is claimed as new is as follows:

1. An apparatus for compacting powder material to a compacted article provided with a sharp edge at the junction of two surfaces of said article, said apparatus comprising a die having an upper surface and a bore vertically disposed in said die, said bore having peripheral walls forming a die cavity disposed at the top of said bore, said die cavity forming an opening in said upper surface of said die, a punch reciprocably movable in said bore and having an upper end face, a housing displaceable from a position away from said die cavity opening to a position over said die cavity opening, said housing having an end face engageable with said die upper surface, a longitudinal bore in said housing having an opening in said end face, a pair of concentric telescopic counterpunches permanently disposed in said bore in said housing, the innermost of said counterpunches being rigidly interconnected with said housing and having an end face of a peripheral perimeter smaller than the peripheral perimeter of said die cavity opening and the outermost of said counterpunches having an end face of a peripheral perimeter larger than the peripheral perimeter of said die cavity opening and smaller than said housing end face opening, the end face of said outermost counterpunch having a surface portion proximate the peripheral perimeter thereof engageable with said die upper surface and the end face of said outermost counterpunch having an aperture slidably accepting the end of said innermost counterpunch and a surface portion from the edge of said aperture to the surface portion engageable with said die upper surface overlapping said die cavity opening, means simultaneously advancing said housing end face toward said die upper surface for engagement therewith and said innermost counterpunch end face toward said die cavity opening whereby the advance of said housing and of said innermost counterpunch is limited to a predetermined position relative to said outermost counterpunch by engagement of said housing and bore with said die upper surface, and means advancing said punch toward said counterpunches for compacting powder material disposed in said die cavity between the end face of said punch, the end face of said innermost counterpunch and the portion of the end face of said outermost counterpunch overlapping said die cavity opening, whereby an article molded in said die cavity is provided with a lower face formed by said punch end face, sidewalls formed by the walls of said die cavity and an upper face formed by the surface of the end faces of both said counterpunches disposed over said die cavity opening, said sharp edges being at the junction between said sidewalls and said upper face.

2. The apparatus of claim 1 wherein said counterpunches have each a peripherally circular main body portion, and further comprising means preventing rotation of said innermost counterpunch relative to said outermost counterpunch and means preventing rotation of said outermost counterpunch relative to said housing.

3. The apparatus of claim 2 wherein said means preventing rotation of said outermost counterpunch relative to said housing comprises a bore radially disposed in said housing, a longitudinal groove formed on the peripheral surface of said outermost counterpunch, a ball disposed in said bore in engagement in said groove, and means adjusting the radial position of said ball in said bore.

4. The apparatus of claim 1 further comprising corresponding abutment means in said housing and on said outermost counterpunch limiting in one direction the displacement of said outermost counterpunch relative to said housing.

5. The apparatus of claim 1 wherein said innermost counterpunch of said housing are mechanically interconnected such as to be displaceable in unison relative to said outermost counterpunch.

6. The apparatus of claim 5 further comprising spring biasing means constantly urging said outermost counterpunch in a direction urging the end face of said outermost counterpunch to project beyond the end face of said innermost counterpunch.

7. The apparatus of claim 6 further comprising abutment means limiting the amount of projection of the end face of the outermost counterpunch beyond the end face of the innermost counterpunch.

8. The apparatus of claim 6 wherein said outermost counterpunch has a top annular surface and said spring biasing means comprises at least one compressed Belleville spring engaging the top annular surface of said outermost counterpunch.

9. The apparatus of claim 1 wherein said end face of said outermost counterpunch has a peripheral perimeter equidistant from the peripheral edge of said aperture in said outermost counterpunch end face.

10. The apparatus of claim 1 wherein the peripheral walls of said die cavity taper outwardly from the bottom of said die cavity to the opening of said die cavity at said die upper surface.

11. The apparatus of claim 1 wherein the end face of said punch is convex.

12. The apparatus of claim 11 wherein the end face of said innermost counterpunch has a projecting ridge disposed at the edge of said end face.

13. A method for compacting powder material into an article having at least two surfaces intersecting in a sharp edge, said method comprising disposing a measured amount of said powder material in a die cavity disposed in a die having an upper surface, said die cavity being closed at its bottom by the end face of a punch reciprocable below said die cavity and said die cavity having an opening at its top, placing above said die cavity opening a housing having a lower surface and provided with a pair of substantially concentric counterpunches disposed reciprocable one within the other, the innermost of said counterpunches being rigidly interconnected with said housing and having an end face with a peripheral perimeter smaller than the peripheral perimeter of the die cavity opening, the outermost of said counterpunches being independently reciprocable and having an end face with a peripheral perimeter larger than the peripheral perimeter of said die cavity opening, the end face of said housing having an aperture accepting the end faces of said outermost and innermost counterpunches, the end face of said outermost counterpunch having an aperture accepting the end of said innermost counterpunch and the end face of said outermost counterpunch forming a first surface portion disposed overlapping said die cavity opening and a second surface portion proximate the peripheral perimeter of said end face having edges disposed beyond said die opening such that said second surface portion of the end face of the outermost of said counterpunches engages said die upper surface and causes said first surface portion to be placed firmly in said overlapping position, simultaneously advancing said housing and the innermost of said counterpunches for engaging said housing lower surface with said die upper surface and for advancing the end face of said innermost counterpunch to a predetermined position over said die opening whereby the advance of said innermost punch is stopped when said housing lower surface engages said die upper surface, advancing said punch for compacting said powder material in a molding cavity defined by the walls of said die cavity, the end face of said punch, the end face of the innermost of said counterpunches and the end face first surface portion of the outermost of said counterpunches overlapping said die opening, removing said housing and said counterpunches from over said die cavity, and advancing said punch to a position at least flush with the die cavity opening for ejecting said article from said die cavity, wherein the sharp edge of said article is formed during compacting of the powder material between the sidewalls of said die cavity and the end face first surface portion of the outermost of said counterpunches overlapping the die opening.

* * * * *

UNITED STATES PATENT AND TRADEMARK OFFICE

CERTIFICATE OF CORRECTION

PATENT NO. : 4,298,563

DATED : Raymond P. DeSantis et al

INVENTOR(S) :

It is certified that error appears in the above–identified patent and that said Letters Patent are hereby corrected as shown below:

Col. 1, line 31, change "3,516,142" to --3,415,142--, line 64, change "being" to --bring--.

Col. 5, line 38, change "42" to --43--.

Col. 9, line 34, change "143" to --132--.

Signed and Sealed this

*Twenty-seventh* Day of *April 1982*

[SEAL]

*Attest:*

GERALD J. MOSSINGHOFF

*Attesting Officer*

*Commissioner of Patents and Trademarks*